US006168073B1

(12) United States Patent
Towle

(10) Patent No.: US 6,168,073 B1
(45) Date of Patent: Jan. 2, 2001

(54) CONTAINER HAVING A SLIDING INNER MEMBER

(75) Inventor: Donald J. Towle, Des Moines, WA (US)

(73) Assignee: Allpak Container, Inc., Renton, WA (US)

( * ) Notice: Under 35 U.S.C. 154(b), the term of this patent shall be extended for 0 days.

(21) Appl. No.: 09/337,611

(22) Filed: Jun. 21, 1999

(51) Int. Cl.[7] ..... B65D 5/38

(52) U.S. Cl. ..... 229/122; 229/125.125; 229/913

(58) Field of Search ..... 229/122, 125.125, 229/913

(56) References Cited

U.S. PATENT DOCUMENTS

| | | | | |
|---|---|---|---|---|
| 1,185,560 | | 5/1916 | Walcutt . | |
| 2,030,797 | * | 2/1936 | Knauth | 229/122 |
| 2,749,019 | * | 6/1956 | Ohlund | 229/122 |
| 3,160,342 | * | 12/1964 | Murdock et al. | 229/125.125 |
| 3,311,283 | | 3/1967 | Shimada et al. . | |
| 3,317,112 | | 5/1967 | Futterman . | |
| 3,400,874 | | 9/1968 | Shimada et al. . | |
| 3,828,923 | | 8/1974 | Phillips, Jr. . | |
| 4,189,087 | * | 2/1980 | Dlugopolski | 229/125.125 |
| 5,020,719 | | 6/1991 | Roth et al. . | |

FOREIGN PATENT DOCUMENTS

| | | | | |
|---|---|---|---|---|
| 179026 | * | 4/1986 | (EP) | 229/125.125 |
| 120997 | * | 2/1948 | (SE) | 229/125.125 |

* cited by examiner

*Primary Examiner*—Gary E. Elkins
(74) *Attorney, Agent, or Firm*—Christensen O'Connor Johnson Kindness PLLC

(57) ABSTRACT

A storage container (20) having integrally formed inner and outer members (24, 22) is disclosed. The outer member (22) includes opposing top and bottom walls (71, 77), opposing side walls (73, 75), a back wall (79) and a front opening (80). The inner member (24) includes a bottom panel (26), opposing side panels (28, 30), a front panel (32) and a fan extension portion (34). The inner member (24) is slidably movable between a retracted position within the outer member (22) and an extended position where the inner member (24) extends from the front opening (80) of the outer member (22).

18 Claims, 12 Drawing Sheets

CONTAINER HAVING A SLIDING INNER MEMBER

FIELD OF THE INVENTION

This invention relates to containers and, more particularly, to containers having an inner member that is slidably movable from a retracted position to an extended position.

BACKGROUND OF THE INVENTION

Containers have been provided in all shapes and sizes and have been utilized for storing all types of items therein. Some containers include an inner slidable element that is received within an outer sleeve-like element. Common examples include select match boxes, cigarette containers and candy dispensers. Typical slidable containers, however, suffer from one or more disadvantages.

First, the construction is often complicated and costly, involving the assembly of separate components. In addition, goods stored in typical slidable containers are often difficult to access and to place back within the container. On the other hand, if the goods are somewhat easily accessible, the container is awkward to manually open and readily reclose. Frequently, another disadvantage is that the stored goods are not adequately secured within the containers to prevent spillage of such goods during transportation of the container. However, if the container is provided with a securement mechanism, it is awkward to operate and also prevents easy access to the goods if several containers are stacked upon one another.

As a result, there exists a need for a container having a slidable inner member that is simple and inexpensive to produce and assemble, and that provides easy access to the contents stored therein.

SUMMARY OF THE INVENTION

In accordance with this invention, a container that includes integrally formed inner and outer members is provided. The outer member includes opposing top and bottom walls, opposing side walls, a back wall and a front opening. The inner member comprises a tray portion and a fan extension portion. The tray portion of the inner member includes a bottom panel, opposing side panels, and a front panel. The inner member is in slidable engagement with the outer member such that the inner member is slidably movable between a retracted position within the outer member to an extended position where the inner member extends from the front opening of the outer member. The inner member is prevented from completely separating from the outer member by the fan extension portion of the inner member. The fan extension portion also controls the extent to which the tray portion is extended from the front opening of the outer member.

In accordance with other aspects of this invention, the inner member of the container is capable of substantially extending from the front opening of the outer member so that objects stored within the container are easily accessible.

In accordance with additional aspects of this invention, the inner and outer members of the container are formed from a single sheet of foldable material.

In accordance with further aspects of the invention, the fan extension portion of the inner member includes three foldably connected panel segments that collapse and extend in a manner similar to that of a fan. A first of the panel segments is foldably connected to a back edge of the top wall of the outer member and to a second of the panel segments. A third of the panel segments is foldably connected to the second of the panel segments and to a back edge of the bottom panel of the inner member. When the inner member is in the extended position relative to the outer member, the fan extension is in an oblique relation to the bottom panel of the inner member. On the other hand, when the inner member is in the retracted position within the outer member, the first of the panel segments is disposed adjacent to the interior surface of the back wall of the outer member, and the bottom surfaces of the second and third panel segments are disposed adjacent to one another. Furthermore, when the inner member is in the retracted position, the bottom panel of the inner member is also in substantially coincident relation with the inner surface of the back wall of the outer member.

In accordance with still further aspects of the invention, the length of the outer member is greater than the length of the inner member when located in the retracted position. In this regard, a ledge portion is defined at the open end of the outer member.

In accordance with yet other aspects of this invention, the outer member of the container includes at least one selectively engageable securement tab that, when engaged, prevents the inner member from being slidably extended from the front opening of the outer member. Preferably, the container includes two selectively engageable securement tabs that are integrally formed on the ledge portion of the outer member at comers of the ledge portion formed by the top wall and opposing side walls of the outer member.

In accordance with yet still other aspects of this invention, the inner member of the container includes a finger access opening for use in slidably extending the inner member from within the outer member. Preferably, the finger access opening is located along a top edge of the front panel of the inner member. Even further, the finger access opening is preferably a semi-circular recess ideal for receiving a person's finger to pull the inner member from within the outer member. Alternatively, an access opening can be created along a top edge of the front panel by decreasing the height of the front panel to less than that of the side walls of the outer member.

As will be readily appreciated from the forgoing description, the invention provides a container that includes integrally formed inner and outer members, and thus is easy and cost effective to both manufacture and assemble. Furthermore, the fan extension portion of the inner member permits the inner member to be fully extendible from the front opening of the outer member such that goods stored therein can be easily accessed or placed back within the container. The selectively engageable securement tabs provide for the securement of the goods within the container, while maintaining the ease of access to the goods. Finally, a container formed in accordance with this invention can be stacked upon other such containers and the contents of any of such containers can be easily accessed without having to remove the container from the stack.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
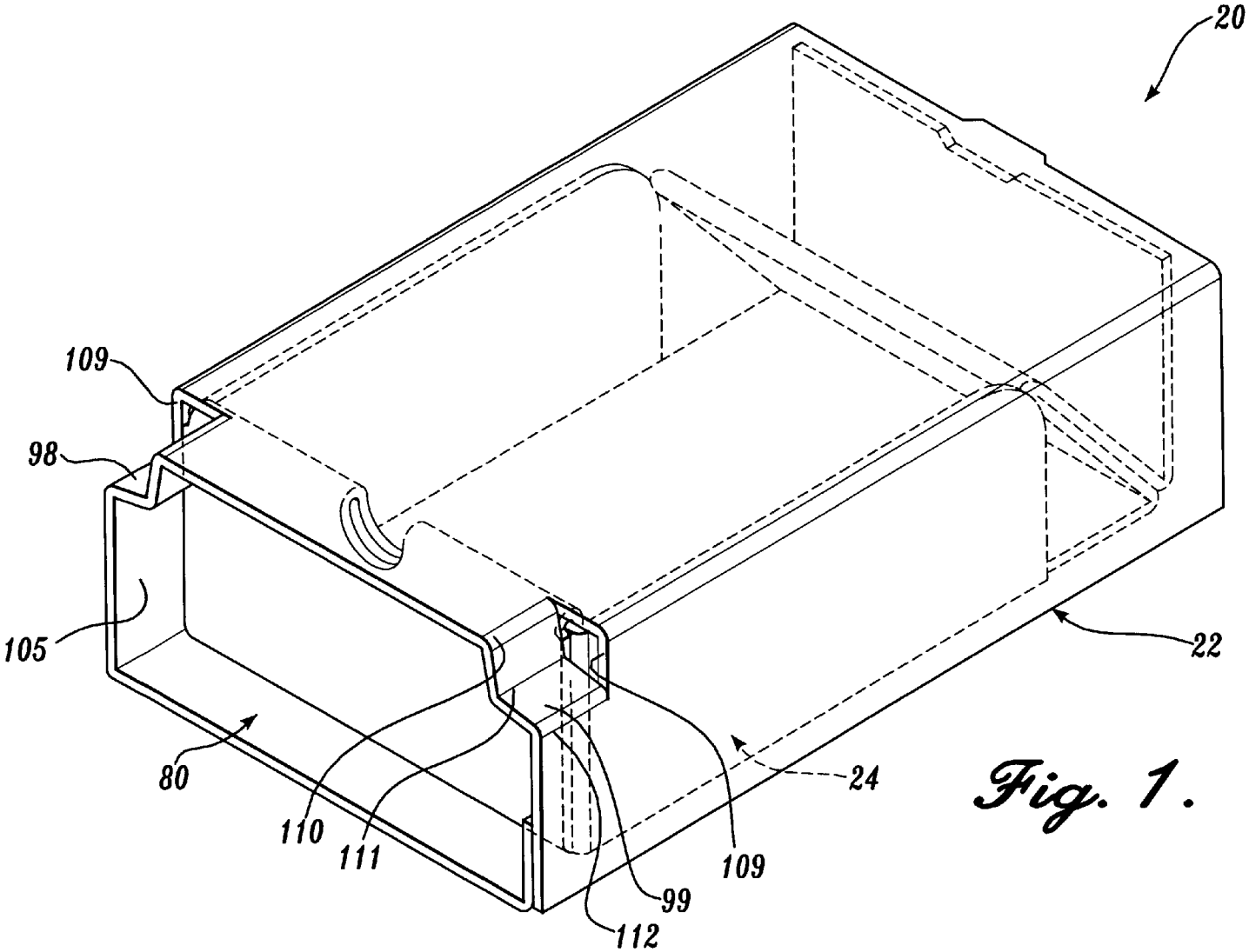
FIG. 1 is a perspective view of a container formed in accordance with this invention illustrated in a locked position.
Figure 2:
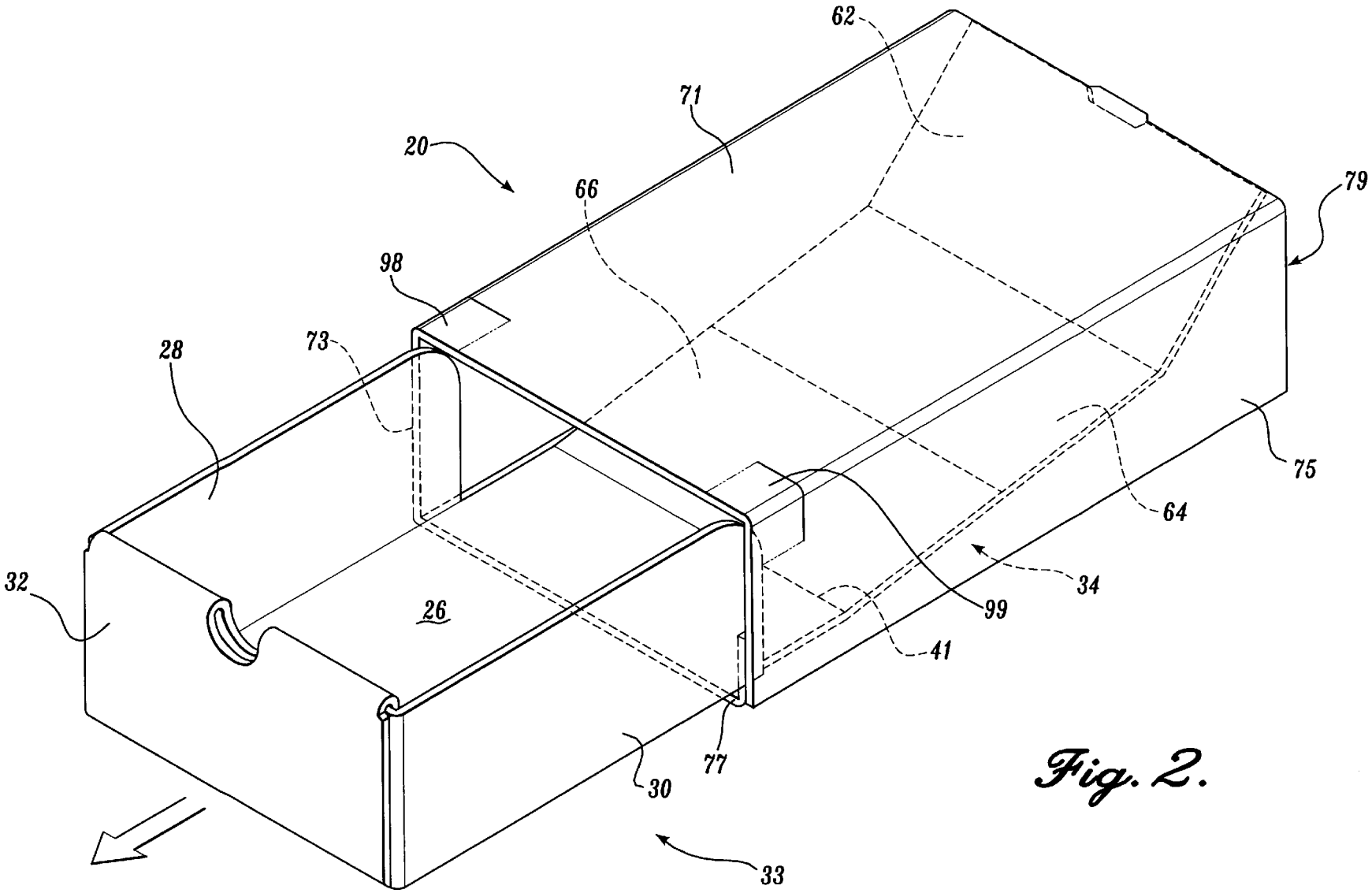
FIG. 2 is a perspective view of the container of this invention illustrating an inner member in an extended position relative to an outer member.

The present invention is directed to a container having integrally formed inner and outer members. FIGS. 1 and 2 illustrate a container 20 that includes an outer member 22 and an inner member 24. The outer member 22 includes opposing top and bottom walls 71 and 77, respectively, opposing side walls 73 and 75, a back wall 79, and a front opening 80. The front opening 80 is located opposite the back wall 79 and is peripherally defined by front edges of the opposing top and bottom walls 71 and 77 and the opposing side walls 73 and 75. The outer member 22 of the container 20 preferably has a rectangular sleeve configuration when assembled.

The inner member 24 includes a tray portion 33 and a fan extension portion 34. The tray portion 33 includes a bottom panel 26, opposing side panels 28 and 30 and a front panel 32. The tray portion 33 is foldably connected to the outer member 22 via the fan extension portion 34. In particular, as best shown in FIG. 2, the bottom panel 26 of the tray portion 33 is foldably connected to the fan extension 34 along a foldline 41, which defines both a back edge of the bottom panel 26 and a front elongate edge of the fan extension portion 34. The fan extension portion 34 is, in turn, foldably connected to the top wall 71 of the outer member 22 along a foldline 67, which defines both a back elongate edge of the fan extension portion 34 and a back edge of the top wall 71.

The fan extension portion 34 includes preferably three foldably connected panel segments 62, 64 and 66. The first of the panel segments 62 is foldably connected to the top wall 71 of the outer member 22 along the foldline 67, while the third of the panel segments 66 is foldably connected to the bottom panel 26 of the tray portion 33 along the foldline 41. The second of the panel segments 64 foldably connects the first of the panel segments 62 to the third of the panel segments 66 as shown in FIG. 2.

Once the container 20 is fully assembled, the inner member 24 is in slidable engagement with the outer member 22. In particular, the bottom panel 26 of the inner member is in slidable engagement with an interior surface of the bottom wall 77 of the outer member, while the opposing side panels 28 and 30 of the inner member are in slidable engagement with interior surfaces of the opposing side walls 73 and 75 of the outer member, respectively. In this regard, the inner member 24 is slidably movable in relation to the outer member 22 between a retracted position and an extended position.

FIG. 1 illustrates the inner member 24 in the retracted position within the outer member 22 such that the inner member 24 is fully received within the outer member 22. The inner member 24 is extendible from the front opening 80 of the outer member 22 until it reaches the extended position as, shown in FIG. 2. Preferably, in the extended position, the tray portion of the inner member substantially extends from the front opening of the outer member. In particular, preferably at least approximately ⅔ of the tray portion of the inner member extends from the front opening of the outer member.

The extent to which the inner member 24 can be extended from the front opening 80 of the outer member is controlled by the length of the fan extension portion 34 and thus, in turn, controlled by the number of panel segments that comprise the fan extension. As mentioned above, the fan extension preferably includes three panel segments. However, it will be appreciated by those skilled in the art and others that any number of panel segments can be used. Thus, it will also be appreciated by those skilled in the art and others that the tray portion of the inner member can entirely extend from the front opening of the outer member. However, in any case, the tray portion remains connected to the outer member via the fan extension, preventing detachment of the inner member from the outer member.

While the inner member 24 is in its retracted position as shown in FIG. 1, the length of the outer member 22 is greater than the length of the inner member such that a ledge portion 105 of the outer member is defined at the open end of the outer member 22. The ledge portion 105 is defined by the portions of the opposing top and bottom walls 71 and 77 and the opposing side walls 73 and 75 of the outer member 22 that project beyond the front panel 32 of the inner member 24. The ledge portion 105 includes selectively engageable securement tabs 98 and 99 positioned at the corners preferably defined by the top wall 71 and each of the opposing side walls 73 and 75 at the open end of the outer member 22.

By pressing the selectively engageable securement tabs 98 and 99 inward, the securement tabs 98 and 99 become L-shaped and engage the front panel of the inner member preventing the extension thereof, as shown in FIG. 1. Alternatively, by pushing the engaged securement tabs 98 and 99 outward to their original position as shown in FIG. 2, the inner member 24 is no longer locked within the outer member in its retracted position, but can be extended therefrom. It will be appreciated by those skilled in the art and others that, while the container 20 preferably includes two selectively engageable securement tabs, it may include one or more such securement tabs.

Figure 3:
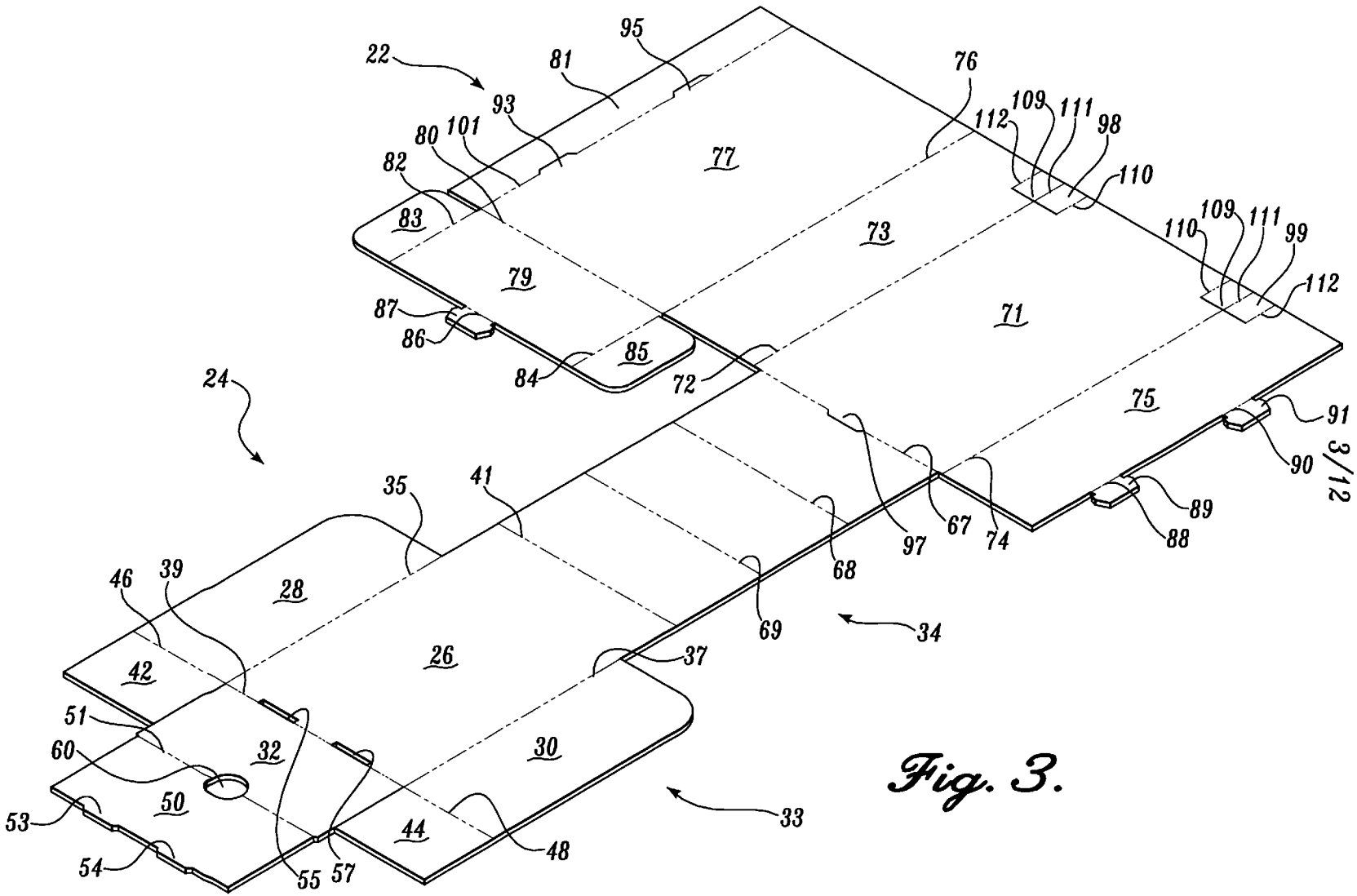
FIG. 3 is a top plan view of the sheet for forming the container depicted in any of FIGS. 1–3.

As mentioned above, the container 20 includes integrally formed inner and outer members. In this regard, the container 20 is constructed from a single sheet of foldable material as illustrated in FIG. 3. Preferably, the sheet material is a sheet of cardboard or other similar corrugated material. In addition, any one or more of the foldable connections defined by foldlines 35, 37, 39, 41, 51, 67, 68, 72, 74, 76, 80, 82, 84, 86, 88, 90, 101, 110, 111, and 112 may be scored to provide flexibility along those foldlines of the sheet of foldable material.

Figure 4:
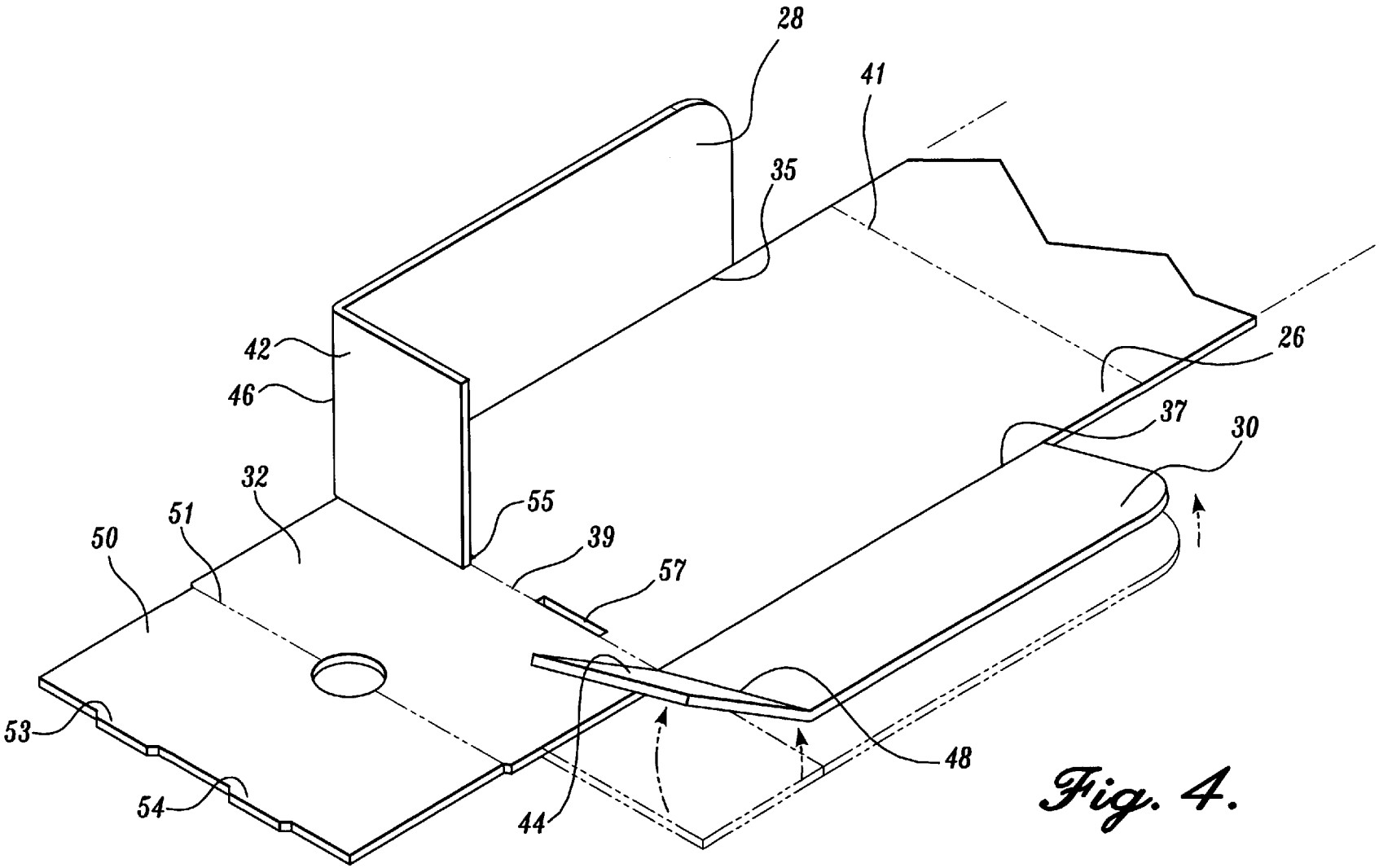
FIG. 4 is a top fragmentary view of the container of this invention illustrating a partially assembled tray portion of the inner member of the container.
Figure 8:
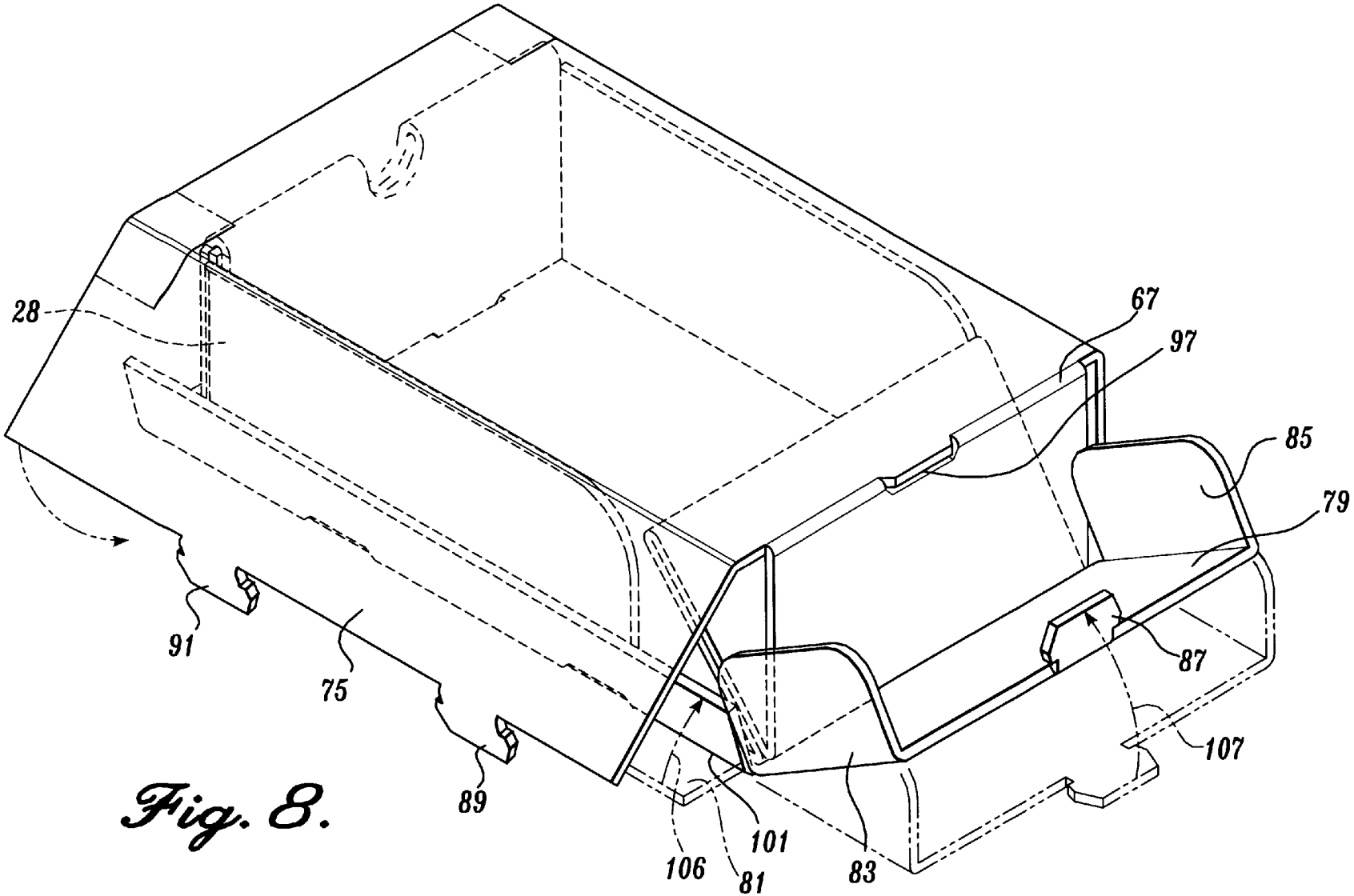
FIG. 8 is a perspective view of the container of this invention illustrating how the outer member is finally assembled to encompass the inner member therein.

FIG. 4 illustrates a top fragmentary view of a partially assembled inner member 24 of the container 20. The side panel 30 is moved to a position normal to the bottom panel 26 at a foldline 37, as shown by the arrows in FIG. 4. The side panels 28 and 30 are preferably shorter in length than the bottom panel 26 to facilitate and accommodate the collapse of the fan extension portion and tuck flaps 83 and 85 as shown in FIGS. 1 and 8. Returning to FIG. 4, the side panel 30 includes a closure flap 44 foldably connected to a front edge of the side panel 30 at a foldline 48. Similarly, the side panel 28 includes a closure flap 42 foldably connected to a front edge of the side panel 28 at a foldline 46. In their assembled positions, closure flaps 42 and 44 are positioned normal to their respective side panels 28 and 30 and to the bottom panel 26, such that a bottom edge of each of the closure flaps 42 and 44 lies adjacent to a foldline 39, which defines the foldable connection between the front panel 32 and the bottom panel 26.

Figure 5:
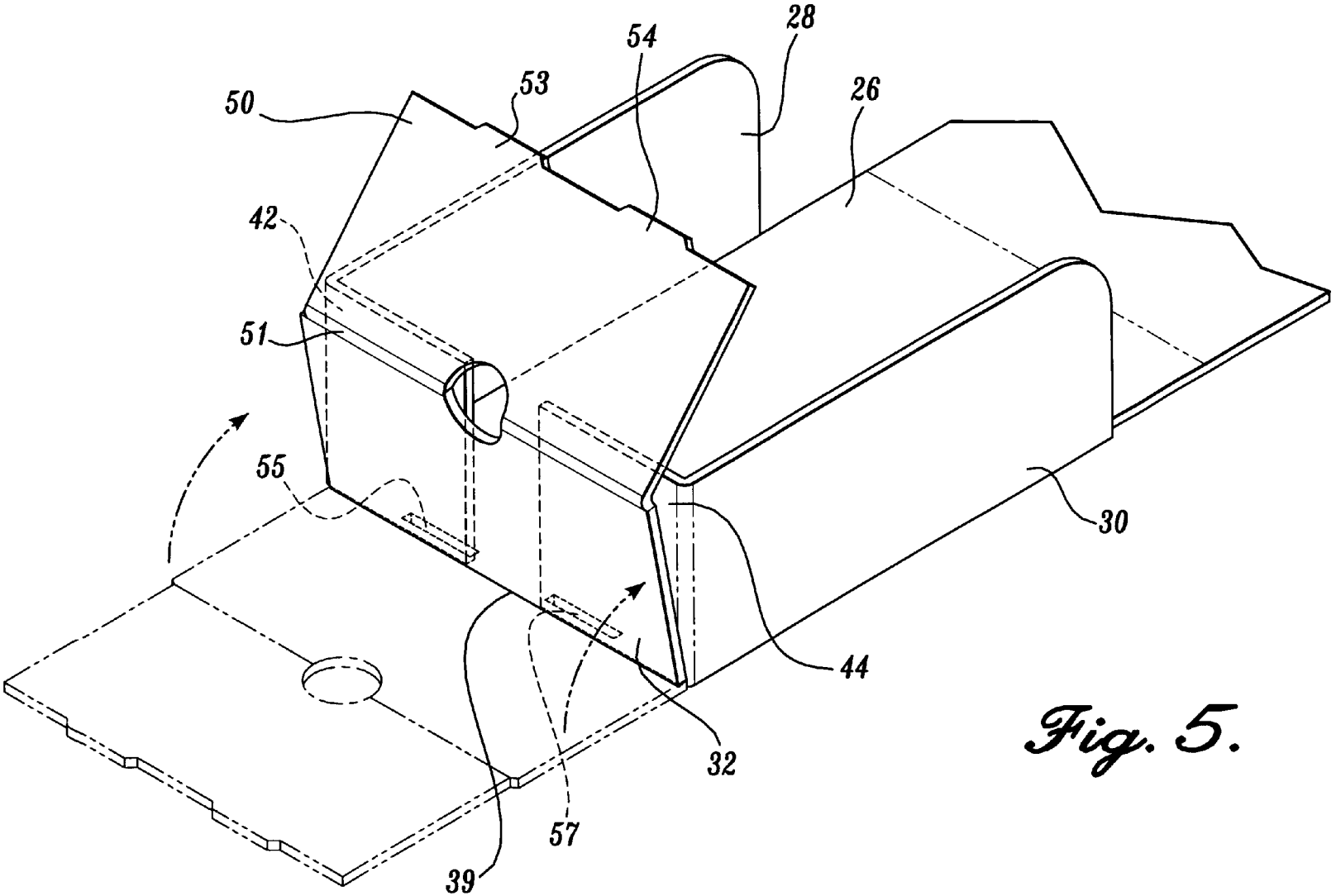
FIG. 5 is a top fragmentary view of the container of this invention illustrating a more completely assembled tray portion of the inner member of the container.

FIG. 5 illustrates a top fragmentary view of the container showing a more completely assembled inner member 24. The front panel 32 of the inner member 24 includes an overlapping front flap 50 foldably connected to the front panel 32 at a foldline 51, defining a top edge of the front panel 32. The overlapping front flap 50 includes closure tabs 53 and 54, which are shaped so as to be received within slots 55 and 57, respectively, positioned near a front edge of the bottom panel 26.

At foldline 39, the front panel 32 folds upward to a position normal to the bottom panel 26, as shown by the arrows in FIG. 5. Once the front panel 26 is correctly assembled, the inner surface of the front panel 32 lies adjacent to the outer surfaces of the closure flaps 42 and 44. Next, the overlapping front flap 50 is folded along the top edge of the front panel 32 at foldline 51 as shown in FIG. 5, and the closure tabs 53 and 54 of the overlapping front flap 50 are received by slots 55 and 57. Once the overlapping front flap 50 is secured by the closure tabs 53 and 54 in its assembled position, the closure flaps 42 and 44 of the side panels are secured and sandwiched between the front panel 32 and the overlapping front flap 50. As a result, the tray portion of the inner member is assembled.

The front panel 32 and the overlapping front flap 50 include semi-circular coincident recesses along the foldable connection therebetween at foldline 51, creating a finger access opening used to extend the inner member outwardly from the outer member. These semi-circular recesses are created from a circular cavity 60, as shown in FIG. 3. When the tray portion is assembled, the foldline 51 intersects the circular cavity 60 through its diameter, as best shown in FIG. 5, creating the semi-circular coincident recesses.

Figure 6:
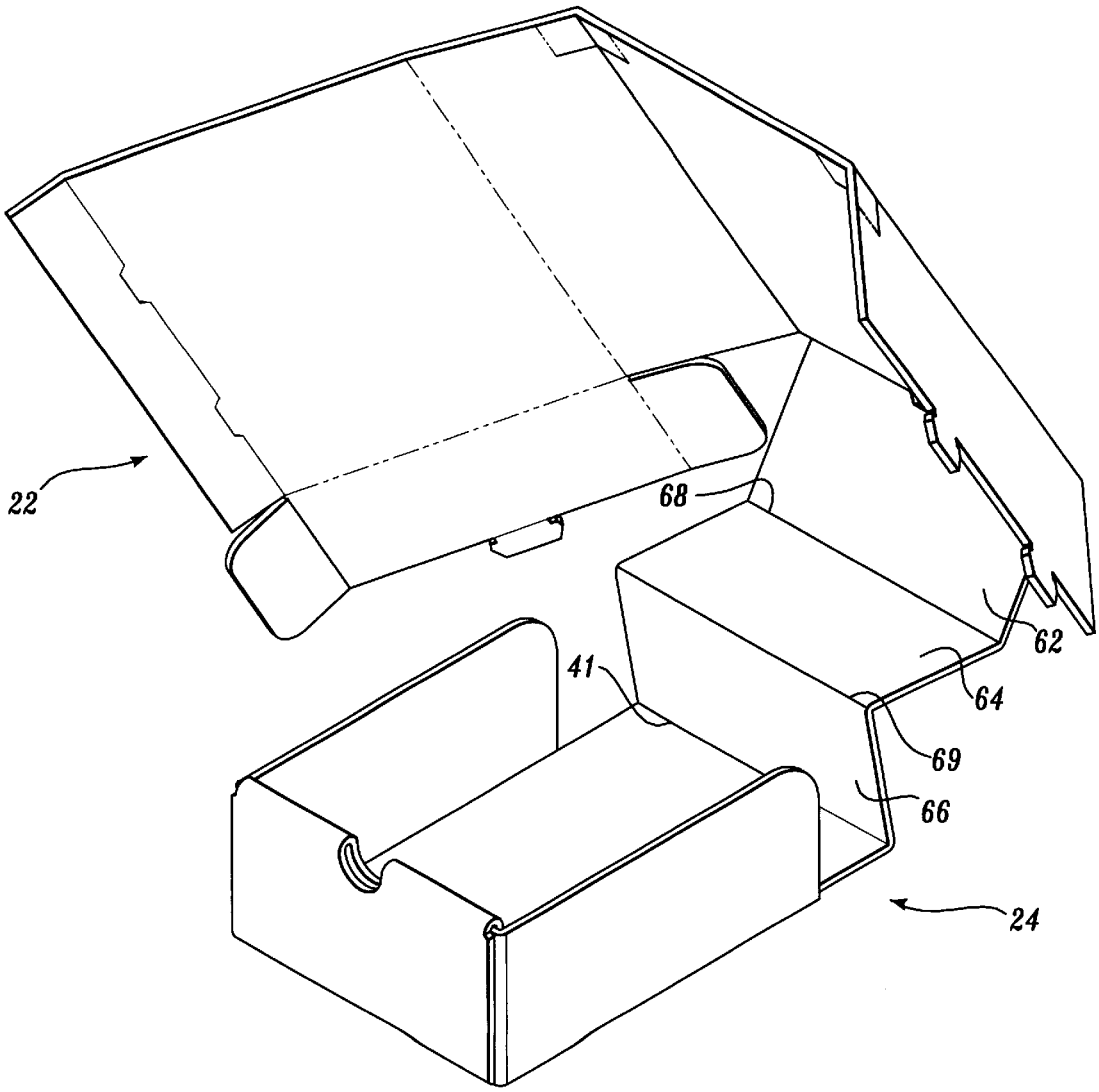
FIG. 6 is a perspective view of the container of this invention illustrating how the outer member of the container is initially assembled in relation to the assembled inner member of the container.

FIG. 6 is a perspective view of the container 20 illustrating how the outer member 22 is initially positioned during assembly thereof to surround and encompass the fully assembled inner member 24. As also shown in FIG. 6, the three panel segments 62, 64 and 66 of the fan extension portion of the inner member 24 are foldably connected to one another to create a fan-shaped configuration. Preferably, the foldable connections between the fan extension portion and the tray portion of the inner member at foldline 41 and between the panel segments at foldlines 68 and 69 are perforated to facilitate the collapse and extension of the fan extension portion when the tray portion is extended from and retracted into the outer member.

Figure 7:
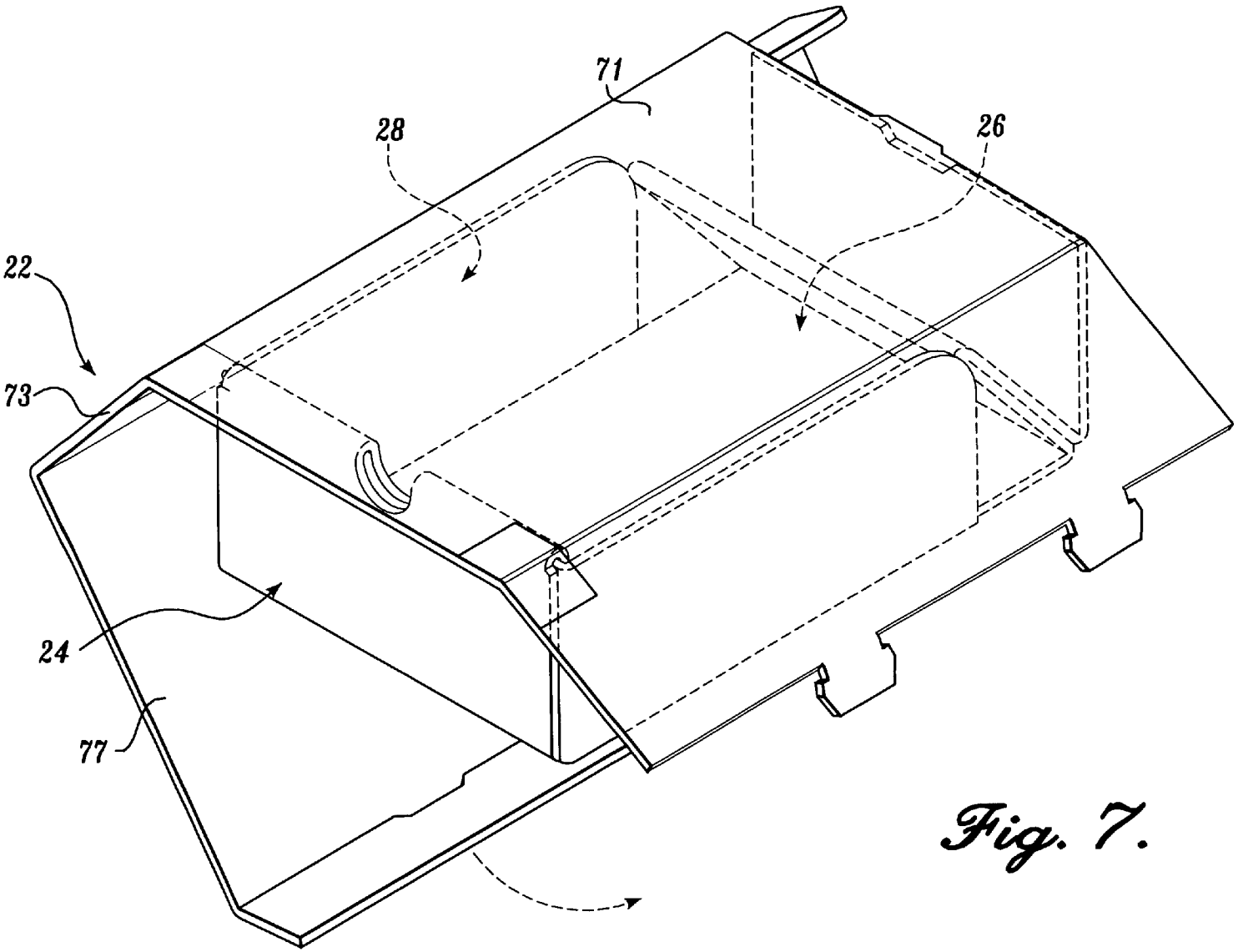
FIG. 7 is a perspective view of the container of this invention illustrating how the outer member is intermediately positioned relative to the assembled inner member in the process of assembling the outer member of the container.

FIG. 7 is a perspective view of the container illustrating how the outer member 22 is intermediately positioned relative to the assembled inner member 24 in the process of assembling the outer member 22. As shown, the top wall 71 is moved to a position on top of the tray portion 33 of the inner member 24 such that the top wall 71 of the outer member 22 is positioned parallel to the bottom panel 26 of the inner member 24. Then, the bottom wall 77 of the outer member 22 is moved around the side panel 28 of the inner member 24 to a position underneath the bottom panel 26 of the inner member as shown by the arrow in FIG. 7. As a result, the side wall 73 of the outer member 22, which is foldably connected to and between the top and bottom panels 71 and 77, is positioned adjacent to the side panel 28 of the inner member 24.

FIG. 8 is a perspective view of the container 20 illustrating how the outer member 22 is finally assembled to create the container 20 of the present invention. The bottom wall 77, positioned adjacent to the bottom panel 26 of the inner member 24, includes a side flange 81 foldably connected thereto along a foldline 101. The side flange 81 is folded to a position adjacent to the outer surface of the side panel 28 as shown by an arrow 106. The side wall 75 of the outer member 22 includes closure tabs 89 and 91 that are suitable for receipt within side apertures 93 and 95 located on the foldline 101 between the bottom wall 77 and the side flange 81. The closure tabs 89 and 91 are inserted into the side apertures 93 and 95, respectively, such that the closure tabs 89 and 91 are sandwiched between the bottom panel 26 of the inner member and the bottom wall 77 of the outer member and such that the side flange 81 is sandwiched between the side wall 75 of the outer member and the side panel 30 of the inner member.

The back wall 79, which is foldably connected to the bottom wall 77, includes tuck flaps 83 and 85 located on opposing sides of the back wall 79 and a closure tab 87. As shown in FIG. 8, the tuck flaps 83 and 85 are folded to a position normal relative to the back wall 79. The back wall 79 is folded upwardly toward a back edge of the top wall 71, as shown by an arrow 107. The closure tab 87 of the back wall 79 is of a type suitable for receipt within a back aperture 97 located on foldline 67 at a back edge of the top wall 71 of the outer member 22. The closure tab 87 is inserted into the back aperture 97 so as to extend into the interior of the outer member 22. The closure tab 87, in its assembled position, lies adjacent to the inner surface of the top wall 71. The tuck flaps 83 and 85 are simultaneously tucked into the interior of the outer member 22 such that the tuck flap 85 lies adjacent to the inner surface of the side wall 73 and the tuck flap 83 lies adjacent to the inner surface of the side wall 75.

Figure 9:
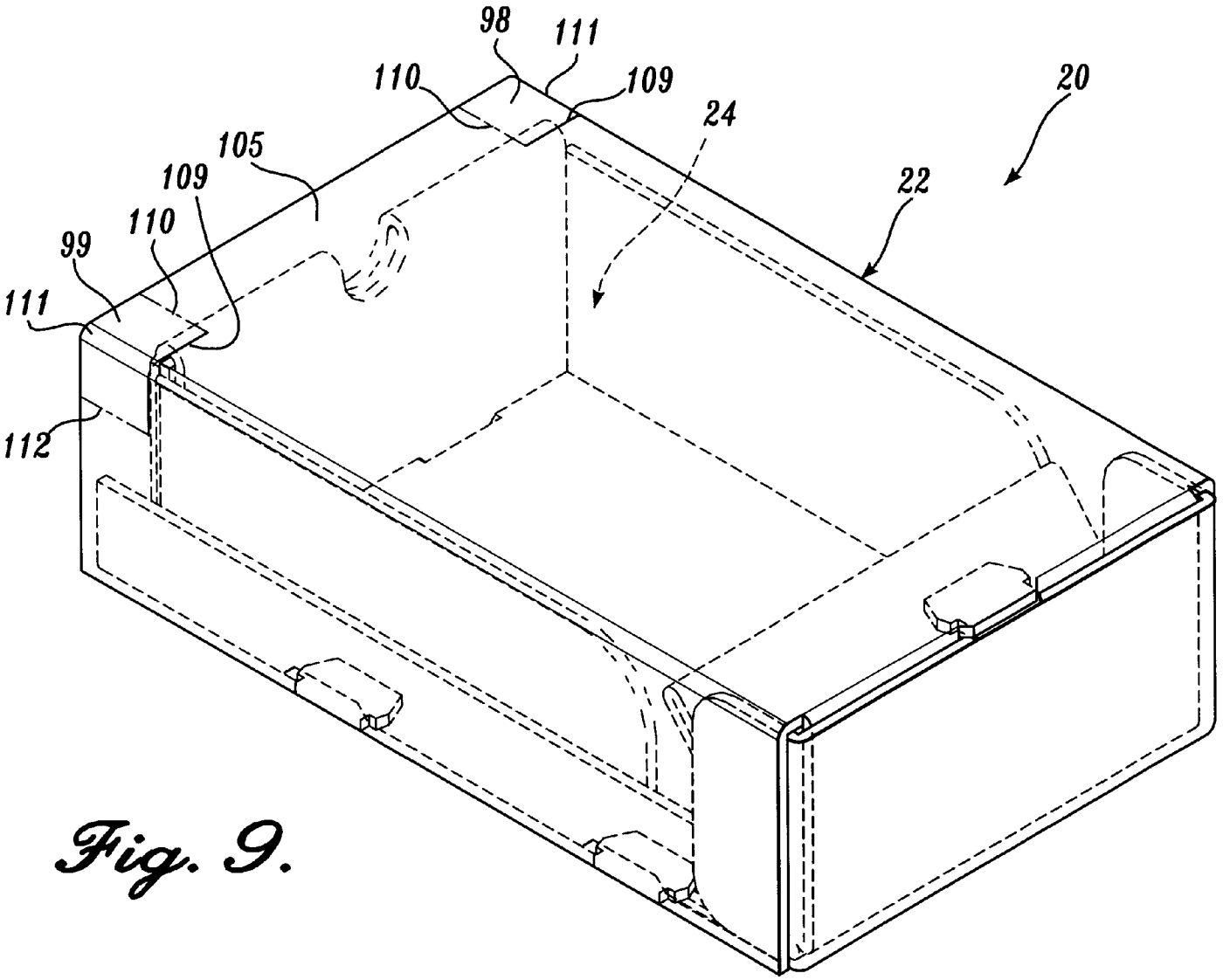
FIG. 9 is a perspective view of the container of this invention fully assembled and in an unlocked position.

FIG. 9 is a perspective view of the assembled container 20 showing the outer member 22 fully encompassing the inner member 24 while in its retracted position. While the inner member is in its retracted position, the fan extension portion 34 is collapsed, and the bottom panel 26 of the tray portion 33 is substantially adjacent to a bottom edge of the back wall 79 of the outer member 22, as best shown in FIG. 1. While collapsed, a bottom surface of the first panel segment 62 lies adjacent to the inner surface of the back wall 79 of the outer member 22. Furthermore, the bottom surfaces of the second and third panel segments 64 and 66 lie adjacent to one another. On the other hand, when the inner member is fully extended as shown in FIG. 2, the panel segments 62, 64, and 66 of the fan extension portion 34 unfold and are located in an oblique position relative to the bottom panel 26 of the inner member 24.

FIG. 9 also illustrates the selectively engageable securement tabs 98 and 99 in their disengaged and unlocked position. Each of the selectively engageable securement tabs 98 and 99 is defined by a slit at a line 109 and foldable edges 110, 111 and 112. The foldable edge 111 is located at a top corner of the ledge portion of the outer member, while the foldable edges 110 and 112 are respectively located on the top wall 71 and one of the side walls 73 or 75 of the ledge portion 105 of the outer member 22, as shown in FIGS. 1 and 9. Preferably, the foldable edges 110, 111 and 112 are perforated to better facilitate the engagement and disengagement of the securement tabs 98 and 99. As best shown in FIG. 1, the slit is positioned on the ledge portion of the outer member such that, when depressed, the securement tabs are disposed against the front panel 32 of the retracted inner member 24.

The container 20 as described above and shown in FIGS. 1–9 is ideally suitable for storing shoes. However, it will be appreciated by those skilled in the art and others that the container of this invention can be sized and shaped for storing a variety of items having a variety of sizes.

Figure 10:
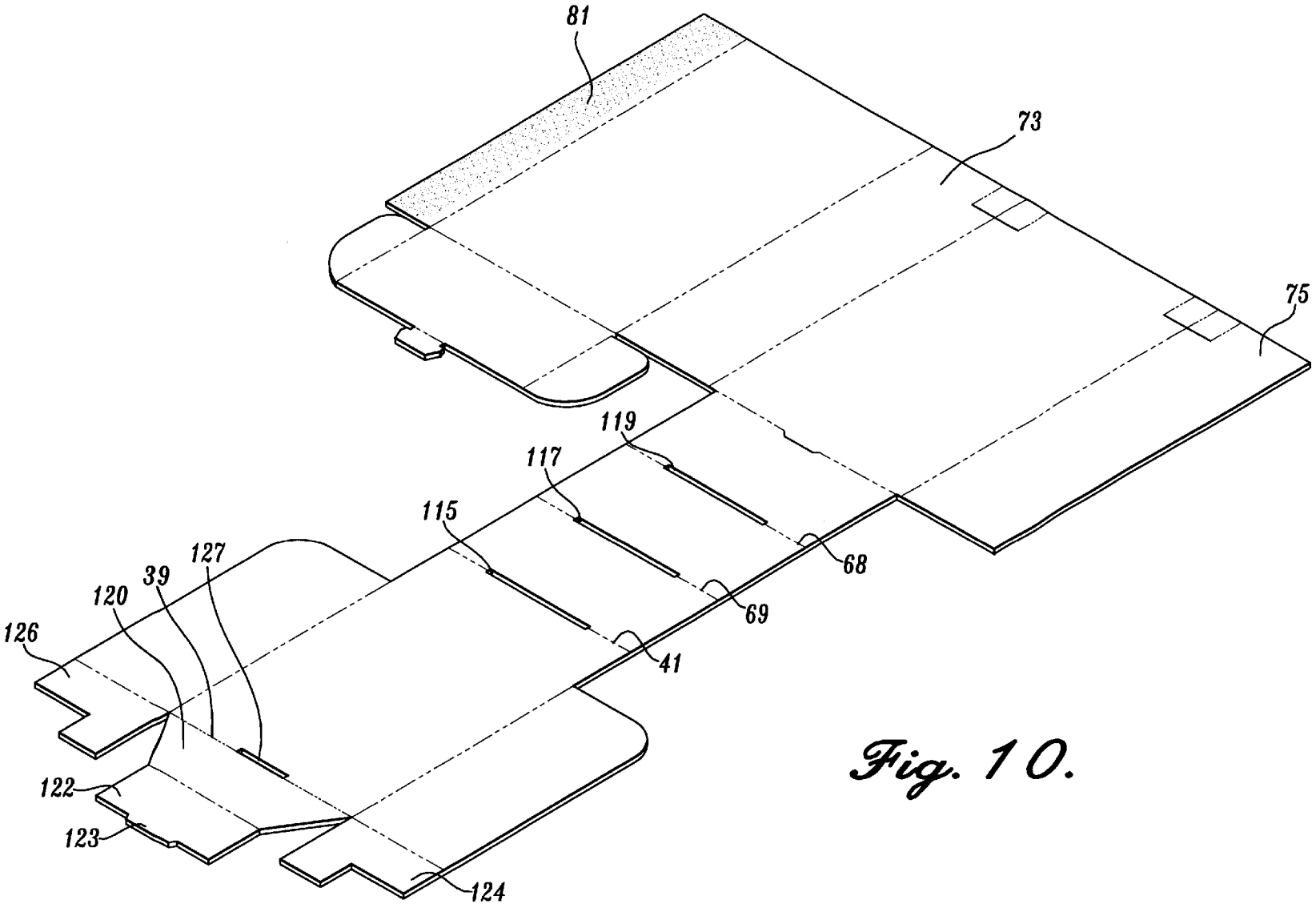
FIG. 10 is a top plan view of a sheet for forming an alternative embodiment of the container depicted in any of FIGS. 1–9.
Figure 11:
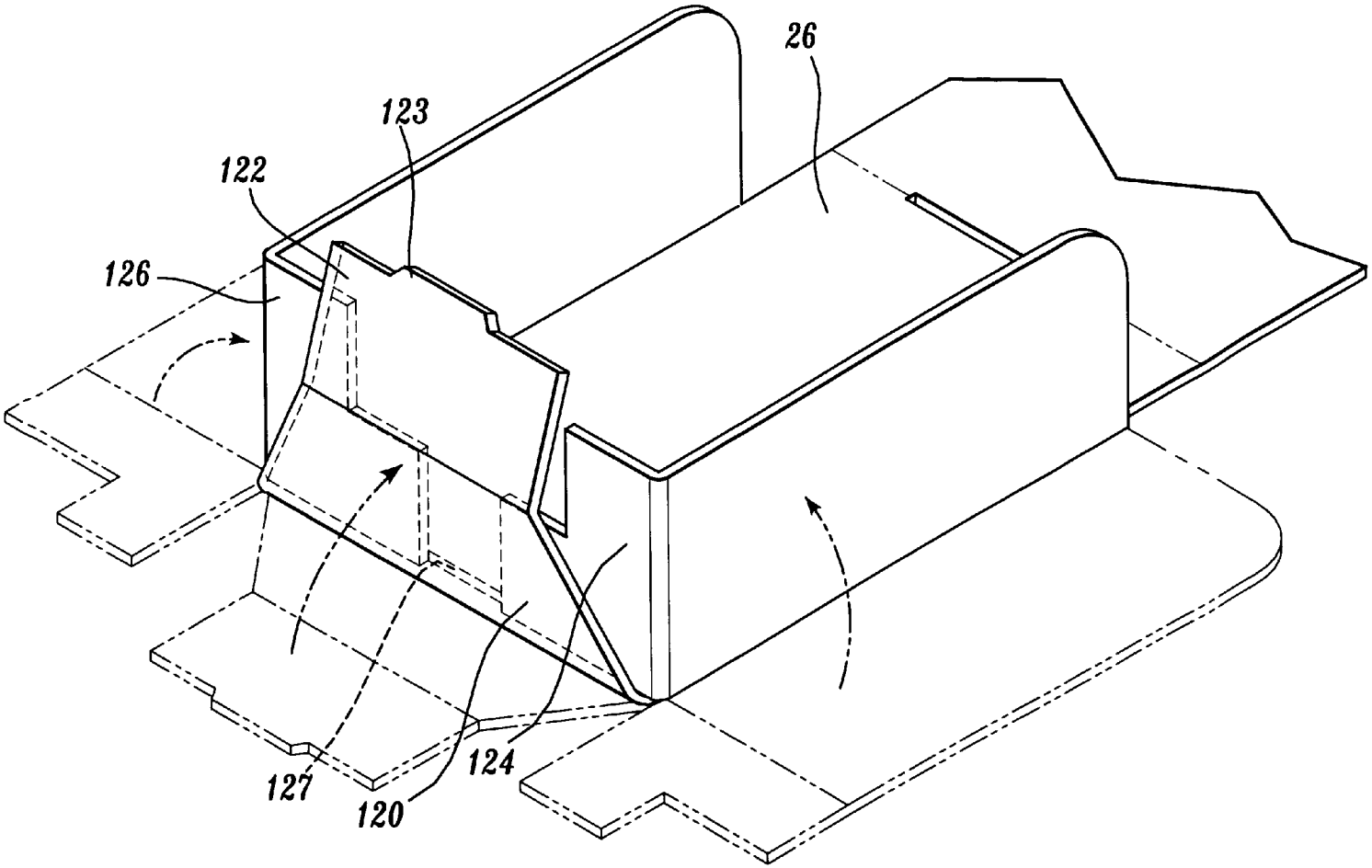
FIG. 11 is a top fragmentary view of the alternative embodiment container depicted in FIG. 10 illustrating a partially assembled tray portion of the inner member.
Figure 12:
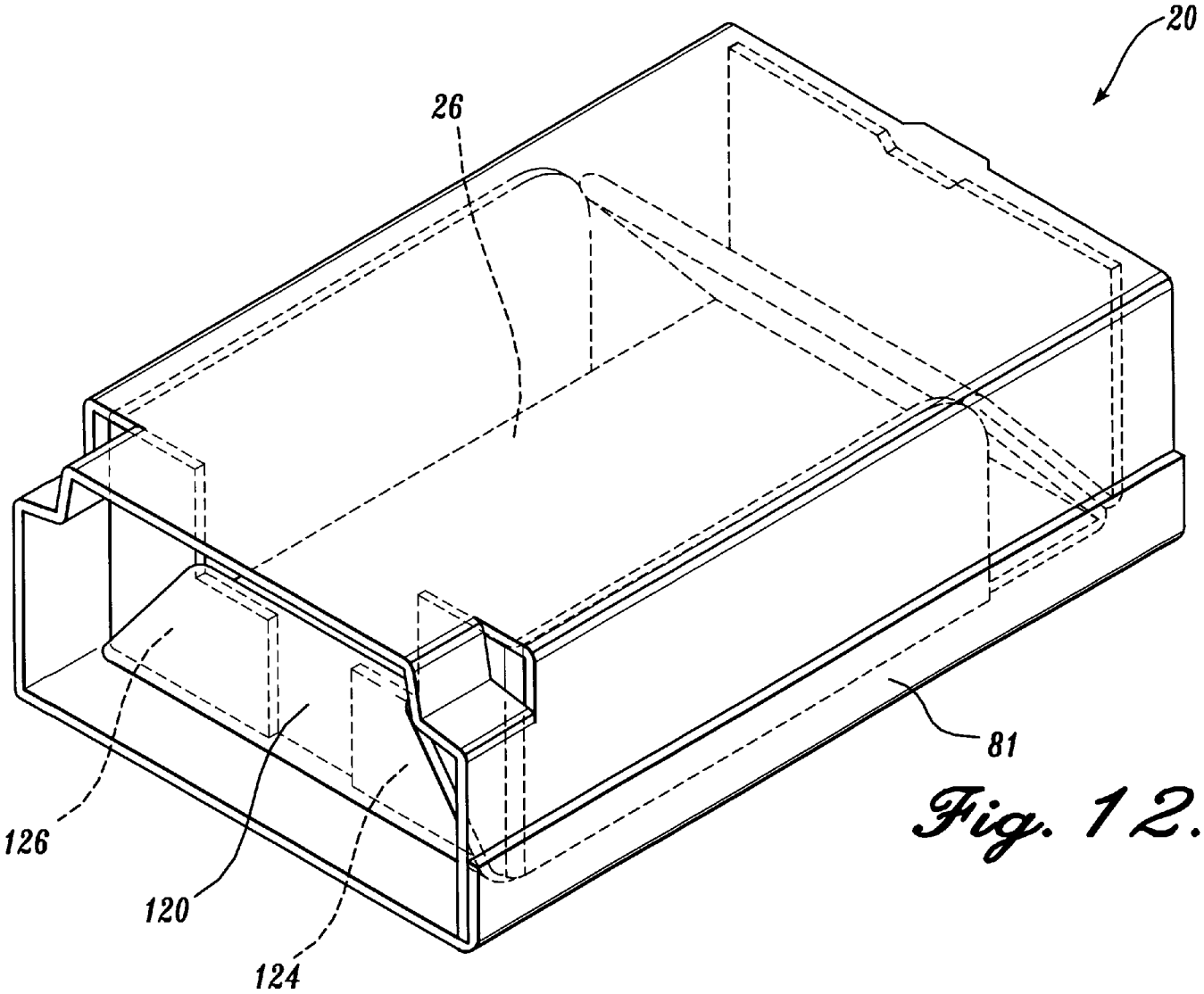
FIG. 12 is a perspective view of the alternative embodiment container depicted in FIGS. 10 and 11 fully assembled.

By way of a nonlimiting example, FIGS. 10, 11 and 12 illustrate an alternative embodiment of the container described in FIGS. 1–9. It will be appreciated by those skilled in the art and others that the alternative embodiment of the container is identical to the container 20 described in FIGS. 1–9 with three exceptions. First, in addition to merely being perforated, each of the foldable connections defined by foldlines 41, 68, and 69, can include slot 115, 117, and 119, respectively, to further facilitate the collapse and extension of the fan extension portion of the container, as best shown in FIG. 10. It will be appreciated by those skilled in the art and others that any number of slots can be provided along each of the foldlines 41, 68 and 69.

Second, instead of creating a finger access opening, the alternative embodiment, as shown in FIGS. 10, 11 and 12, varies the height of the front flap of the inner member. In particular, the alternative embodiment container includes a front panel 120 which is foldably connected to an overlapping front flap 122. The height of both the front panel 120 and the overlapping front flap 122 is less than that of the side walls 73 and 75 of the outer member such that, when assembled, a larger cavity than that provided by the finger access opening in FIG. 5 is created at the front opening of the container. To create such an access opening, the alternative embodiment includes closure flaps 124 and 126, each of which is L-shaped such that the height of the inner portion of each of the closure flaps 124 and 126 is, at a minimum, equivalent to the height of the front panel 120, as shown in FIG. 11. As shown in FIG. 11, the front panel 120 folds upward to a position normal to the bottom panel 26. Then, the overlapping front flap 122 is folded along a top edge of the front panel 120, and a closure tab 123 of the overlapping front flap is received by a slot 127 on the bottom panel 26. As a result, the overlapping front flap 122 secures and sandwiches the inner portion of each of the closure flaps 124 and 126 between the front panel 120 and the overlapping front flap 122. The result is a larger access opening at the front end of the container as shown in FIG. 12. To accomplish this result, the length of the overlapping front flap 122 is shorter than that of the front opening of the container and is governed by the distance between the outer portions of the L-shaped closure flaps 124 and 126 as shown in FIG. 11.

Finally, instead of utilizing closure tabs 89 and 91 and corresponding side apertures 93 and 95 to secure the outer member around the inner member, the alternative embodiment container eliminates such closure tabs 89 and 91 and side apertures 93 and 95 and includes an adhesive on the side flange 81 for securing to the outer surface of the side wall 75 as shown in FIG. 11.

It will be appreciated by those skilled in the art and others that any one or combination of the three changes identified in the alternative embodiment as shown in FIGS. 10, 11 and 12 can be made to the embodiment described in FIGS. 1–9.

As will be readily appreciated by those skilled in the art and others, a container formed in accordance with this invention has a number of advantages. First, by utilizing a single sheet of foldable material to create the container, the container is simple and inexpensive to manufacture and assemble. In addition, goods stored within the container are easily accessible as the fan extension portion of the inner member permits the tray portion to substantially extend from the outer member. Similarly, as the goods are accessed through an open end of the outer member, the goods remain easily accessed when several containers are stacked upon one another. Finally, a container formed in accordance with this invention provides securement of goods stored therein, while maintaining ease of access to the goods.

While the preferred embodiment of the invention has been illustrated and described, it will be appreciated that still other various changes can be made therein without departing from the spirit and scope of the invention. For example, the number of panel segments comprising the fan extension portion of the inner member may be varied to provide the suitable amount of extension of the tray portion of the inner member from the outer member. Furthermore, the number of tabs along the overlapping front flap, the back wall or the side wall, and their corresponding slots, which are used to assemble the container, may also be varied. In addition, the shape of the finger access on the front panel of the inner member may be varied. Thus, within the scope of the appended claims, it is to be understood that the invention can be practiced otherwise than as specifically described herein.

The embodiments of the invention in which an exclusive property or privilege is claimed are defined as follows:

1. A container comprising:

an outer member having opposing top and bottom walls, opposing side walls, a back wall and front opening;

an inner member having a bottom panel, opposing side panels, a front panel and a fan extension portion, wherein the fan extension portion of the inner member is foldably connected to a back edge of the bottom panel of the inner member and to a back edge of the top wall of the outer member;

the inner member integrally formed with the outer member; and the inner member being slidably movable between a retracted position, wherein the inner member is received within the outer member, and an extended position, wherein the inner member extends from the front opening of the outer member.

2. The container of claim 1, wherein the foldable connection between the fan extension portion and the back edge of the bottom panel is a perforated foldable connection.

3. The container of claim 2, wherein the perforated foldable connection includes a slot for providing increased flexibility.

4. A container comprising:

an outer member having opposing top and bottom walls, opposing side walls, a back wall and a front opening;

an inner member having a bottom panel, opposing side panels, a front panel and a fan extension portion, wherein the fan extension portion of the inner member includes three foldably connected panel segments;

the inner member integrally formed with the outer member; and the inner member being slidably movable between a retracted position, wherein the inner member is received within the outer member, and an extended position, wherein the inner member extends from the front opening of the outer member.

5. The container of claim 4, wherein a first of the panel segments is foldably connected to a back edge of the top wall of the outer member and to an elongate edge of a second of the panel segments and wherein a third of the panel segments is foldably connected to an opposing elongate edge of the second of the panel segments and to a back edge of the bottom panel of the inner member.

6. The container of claim 5, wherein the first of the panel segments is disposed adjacent to the interior surface of the back wall of the outer member when the inner member is in the retracted position.

7. The container of claim 6, wherein the three panel segments each have a top surface and a bottom surface and wherein the bottom surface of the second panel segment is disposed adjacent to the bottom surface of the third panel segment when the inner member is in the retracted position.

8. The container of claim 7, wherein the bottom panel of the inner member is in substantially coincident relation with the inner surface of the back wall of the outer member when the inner member is in the retracted position.

9. The container of claim 8, wherein the fan extension is in an oblique relation to the bottom panel of the inner member when the inner member is in the retracted position.

10. The container of claim 9, wherein the foldable connections between the first and second of the panel segments, between the second and third of the panel segments, and between the third panel segment and the bottom panel of the inner member are perforated foldable connections.

11. The container of claim 10, wherein each of the perforated foldable connections includes a slot for each of providing increased flexibility.

12. A container comprising:

an outer member having opposing top and bottom walls, opposing side walls, a back wall and front opening;

an inner member having a bottom panel, opposing side panels, a front panel and a fan extension portion;

the inner member integrally formed with the outer member;

the inner member being slidably movable between a retracted position, wherein the inner member is received within the outer member, and an extended position, wherein the inner member extends from the front opening of the outer member; and the outer member includes at least one selectively engageable securement tab for preventing the inner member from being slidably extended from the outer member when the at least one securement tab is engaged, wherein the length of the outer member is greater than the length of the inner member when in the retracted position to define a ledge portion of the outer member.

13. The container of claim 12, wherein the at least one selectively engageable securement tab is integrally formed on the ledge portion of the outer member.

14. The container of claim 13, wherein the outer member includes two selectively engageable securement tabs located at the comers of the ledge portion formed by the top wall and opposing side walls of the outer member.

15. A container comprising:

an outer member having opposing top and bottom walls, opposing side walls a back wall and a front opening;

an inner member having a bottom panel opposing side panels, a front panel and a fan extension portion;

the inner member integrally formed with the outer member; and the inner member being slidably movable between a retracted position, wherein the inner member is received within the outer member, and an extended position, wherein the inner member extends from the front opening of the outer member, and wherein the inner member includes a finger access opening for slidably extending the inner member from within the outer member.

16. The container of claim 15, wherein the finger access opening is located along a top edge of the front panel of the inner member.

17. A container comprising:

an outer member having opposing top and bottom walls, opposing side walls, a back wall and a front opening;

an inner member having a bottom panel, opposing side panels, a front panel and a fan extension portion, wherein the height of the front panel is less than the height of the side walls of the outer member, forming an access opening along a top edge of the front panel of the inner member;

the inner member integrally formed with the outer member; and the inner member being slidably movable between a retracted position, wherein the inner member is received within the outer member, and an extended position, wherein the inner member extends from the front opening of the outer member.

18. A container comprising:

an outer member having opposing top and bottom walls, opposing side walls, a back wall, and a front opening;

an inner member having a bottom panel, opposing side panels, a front panel and a fan extension portion;

the inner member integrally formed with the outer member;

the inner member being slidably movable between a retracted position, wherein the inner member is received within the outer member, and an extended position, wherein the inner member is capable of substantially extending from the front opening of the outer member; and the outer member being greater in length than the inner member while in the retracted position, defining a ledge portion of the outer member, wherein at least one selectively engageable securement tab is integrally formed on the ledge portion of the outer member.

* * * * *

UNITED STATES PATENT AND TRADEMARK OFFICE

CERTIFICATE OF CORRECTION

PATENT NO. : 6,168,073 B1
DATED : January 2, 2001
INVENTOR(S) : D.J. Towle

It is certified that error appears in the above-identified patent and that said Letters Patent is hereby corrected as shown below:

Column 8, (Claim 1, line 3)
Line 44, "and front" should read -- and a front --

Column 9, (Claim 12, line 3)
Line 46, "and front" should read -- and a front --

Column 10, (Claim 14, line 3)
Line 6, "comers" should read -- corners --

Column 10, (Claim 15, line 3)
Line 10, "walls a" should read -- walls, a --

Column 10, (Claim 15, line 5)
Line 12, "panel opposing" should read -- panel, opposing --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*